US010682028B2

(12) United States Patent
Fodrocy et al.

(10) Patent No.: US 10,682,028 B2
(45) Date of Patent: Jun. 16, 2020

(54) SOFT WALL CURTAIN CLEANER

(71) Applicant: Geerpres, Inc., Muskegon, MI (US)

(72) Inventors: Joseph J. Fodrocy, Muskegon, MI (US); Scott E. Ribbe, West Olive, MI (US); William C. Vanderlinde, Muskegon, MI (US)

(73) Assignee: Geerpres, Inc., Muskegon, MI (US)

( * ) Notice: Subject to any disclaimer, the term of this patent is extended or adjusted under 35 U.S.C. 154(b) by 1226 days.

(21) Appl. No.: 14/848,675

(22) Filed: Sep. 9, 2015

(65) Prior Publication Data

US 2017/0065141 A1 Mar. 9, 2017

(51) Int. Cl.
*A47L 4/02* (2006.01)

(52) U.S. Cl.
CPC ..... *A47L 4/02* (2013.01)

(58) Field of Classification Search
CPC . A47L 4/02; A47L 13/16; A47L 13/12; A47L 13/144; A47L 13/258
USPC ..... 15/144.1, 220.3, 228
See application file for complete search history.

(56) References Cited

U.S. PATENT DOCUMENTS

| | | | | |
|---|---|---|---|---|
| 4,920,601 | A | 5/1990 | Alburas | |
| 7,430,781 | B2 * | 10/2008 | Collins | A47L 4/02 15/220.3 |
| 7,694,379 | B2 * | 4/2010 | Glaug | A47L 13/20 15/209.1 |
| 2009/0094769 | A1 * | 4/2009 | Wilson | A46B 5/0075 15/144.1 |

OTHER PUBLICATIONS

Micronova Curtain Center, www.micronova-mfg.com
Contec DualClean, Contec 2015.

* cited by examiner

*Primary Examiner* — David Redding
(74) *Attorney, Agent, or Firm* — Mitchell Intellectual Property Law, PLLC

(57) ABSTRACT

A soft wall curtain cleaner having an elongated handle over which a slidable handle sleeve is slidably mounted. The handle is connected to a proximate cleaning pad mount. The sleeve includes a support arm which extends past the proximate cleaning pad mount and supports a distal cleaning pad mount oriented generally parallel to the proximate cleaning pad mount. Cleaning pads are mounted on the mounts. In use, the spaced mounts and their associated cleaning pads can be slipped over a curtain strip. The user can then hold the handle in one hand and the slidable handle sleeve in the other, and pull the slidable sleeve towards the user, such that the two cleaning pads firmly engage both sides of the curtain strip. The user then forces the assembly downwardly such that the cleaning pads slide downwardly over the curtain strip and clean it on both sides, throughout its length.

20 Claims, 7 Drawing Sheets

SOFT WALL CURTAIN CLEANER

FIELD AND BACKGROUND OF THE INVENTION

The present invention relates to the field of soft wall curtain cleaners. So-called "soft wall curtains" are comprised of a plurality of plastic strips which hang down from an overhead support. Each strip is usually about 8-12" wide, and the strips typically overlap. Most typically, each strip is a strip of clear plastic.

Exemplary soft wall curtain cleaners comprise an elongated handle with a cleaning fixture mounted on the end of the handle. The cleaning fixture is often generally U-shaped, comprising a first leg which extends laterally from the end of the handle to its juncture with a base leg which extends laterally away from the first leg to its juncture with an arrangement of two spaced arms which extend parallel to the first leg for a distance of 8-12" over and past the end of the handle. A cleaning pad or cloth is fitted over each of the two spaced arms. There is space between the two arms that a plastic curtain strip slips easily between the two arms. The cleaner is then oriented at an angle such that as one pulls the handle downwardly, both sides of the plastic strip are engaged by the cleaning cloth on the two spaced cleaner support arms.

In another variation, the cleaning fixture includes a leg which simply extends straight out of the end of the elongated handle and is formed into two spaced cleaner support arms which extend laterally from the outwardly extending arm. Such a cleaner and its manner of use is disclosed in U.S. Pat. No. 4,920,601.

SUMMARY OF THE INVENTION

The soft wall curtain cleaner of the present invention comprises an elongated handle over which a slidable handle sleeve is slidably mounted. The handle is connected to a proximate cleaning pad mount. The sleeve includes a support arm which extends past the proximate cleaning pad mount and supports a distal cleaning pad mount oriented generally parallel to the proximate cleaning pad mount. When cleaning pads are mounted on the mounts, the spaced mounts can be slipped over a curtain strip. The user can then hold the handle in one hand and the slidable handle sleeve in the other, and pull the slidable sleeve towards the user, such that the two cleaning pads firmly engage both sides of the curtain strip. The user then forces the assembly downwardly such that the cleaning pads slide downwardly over the curtain strip and clean it on both sides, throughout its length.

These and other objects, advantages and features of the invention will be more fully understood and appreciated by reference to the written specification and appended drawings.

DESCRIPTION OF THE PREFERRED EMBODIMENT

Figure 1:
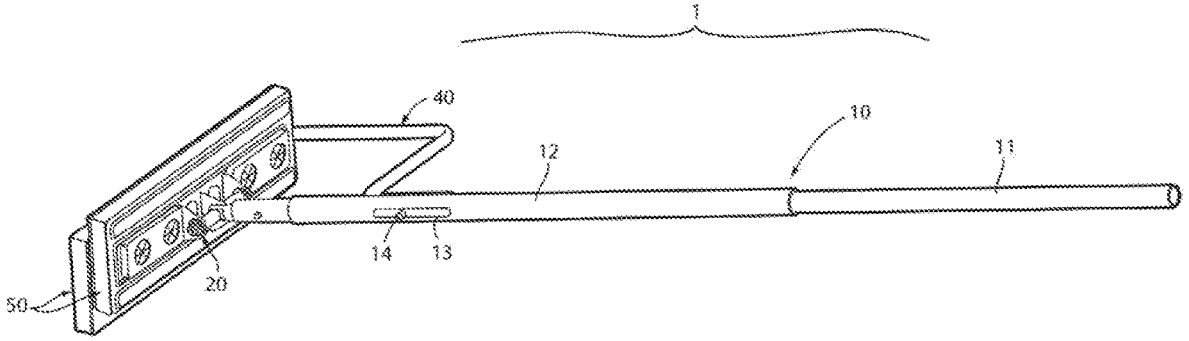
FIG. 1 is a perspective view of the soft wall curtain cleaner of the preferred embodiment.
Figure 2:
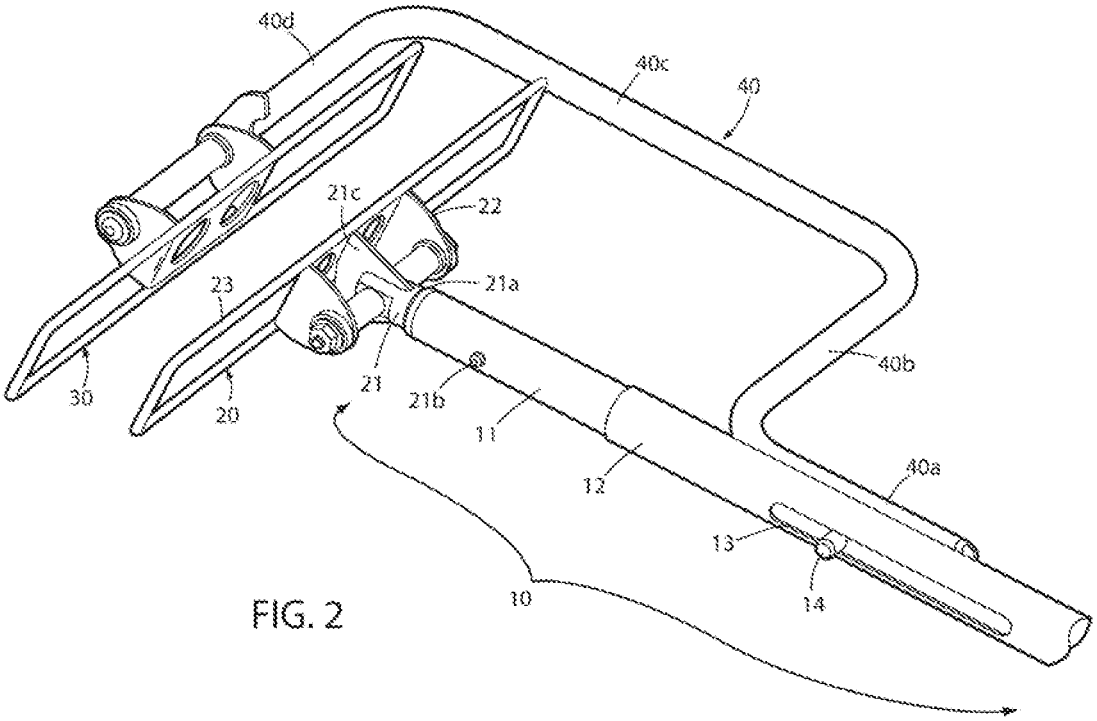
FIG. 2 is a perspective view of the cleaning end of handle 10 and its connection to the proximate cleaning pad mount 20 and the distal cleaning pad mount 30.
Figure 3:
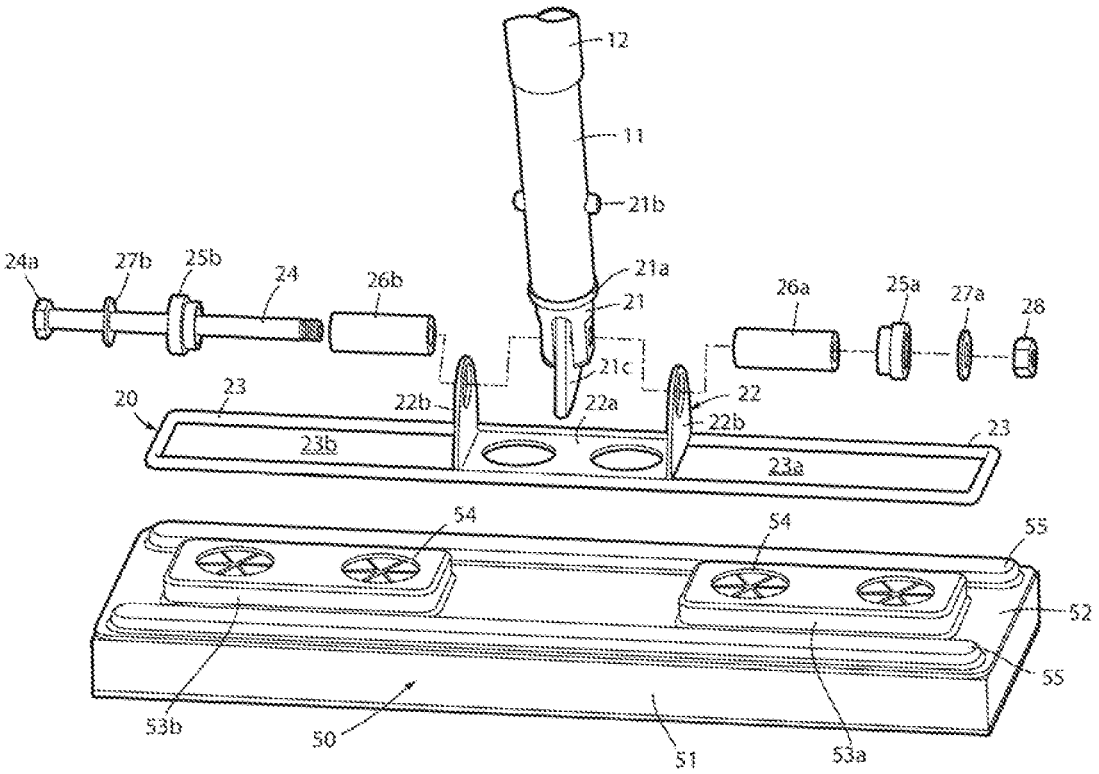
FIG. 3 is an exploded perspective view of the cleaning end of handle 10 and its connection to the proximate cleaning pad mount 20, showing cleaning pad 50 exploded away from cleaning pad mount 20.
Figure 4:
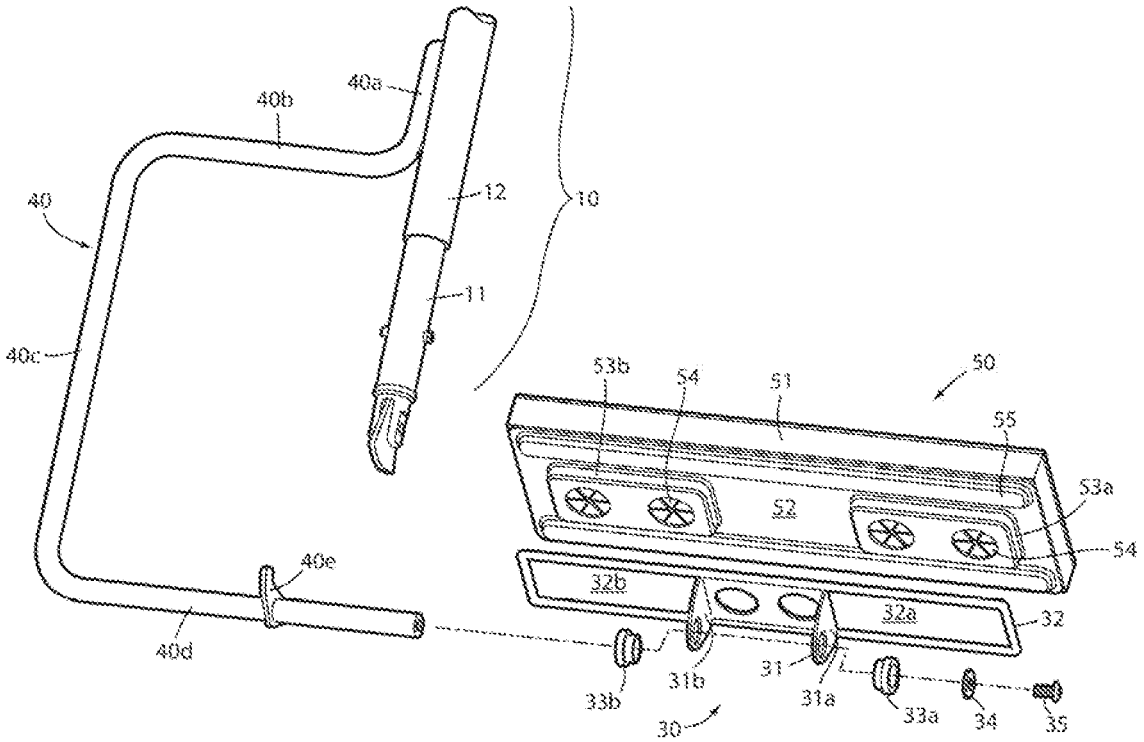
FIG. 4 is an exploded perspective view of the cleaning end of handle 10 and its connection to distal cleaning pad mount 30 via distal cleaning pad mount support arm 40, showing the cleaning pad 50 exploded away from cleaning pad mount 30.
Figure 5:
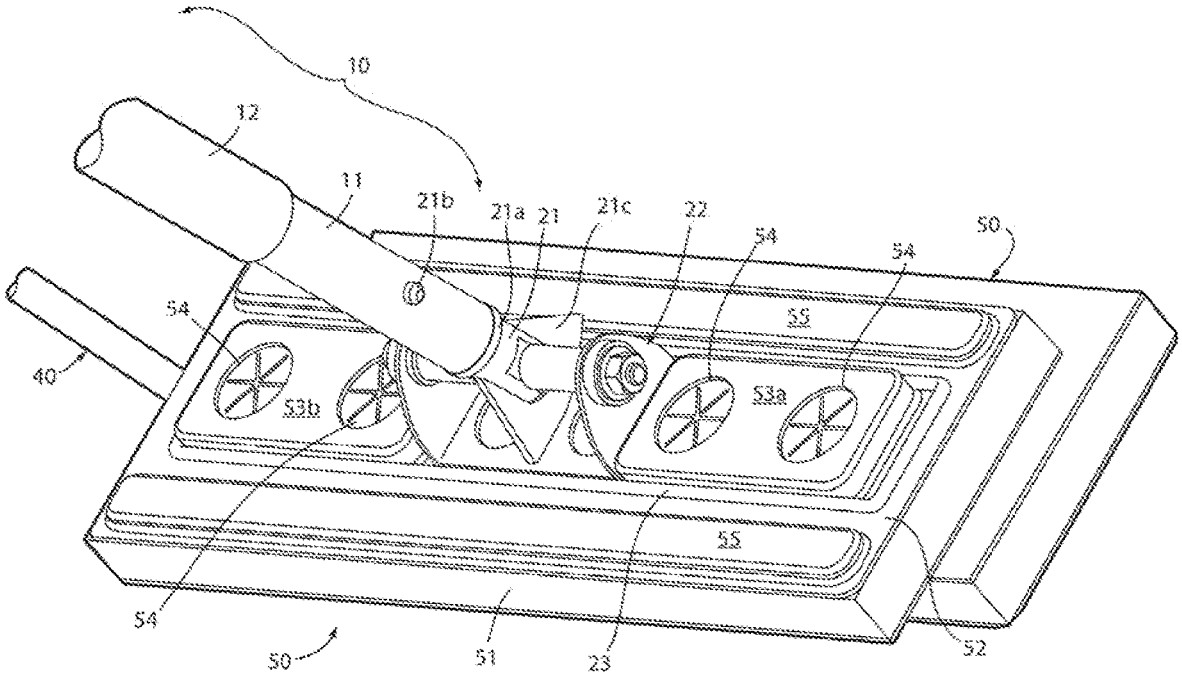
FIG. 5 is a close up perspective view showing the cleaning pads 50 mounted in their respective mounting frames.
Figure 8:
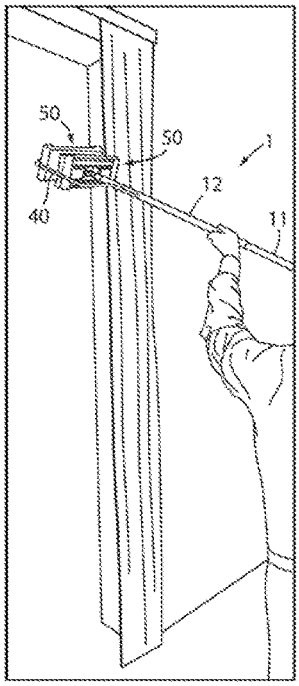
FIG. 8 is a perspective view showing the cleaning tool as it is slipped over a plastic curtain strip.
Figure 9:
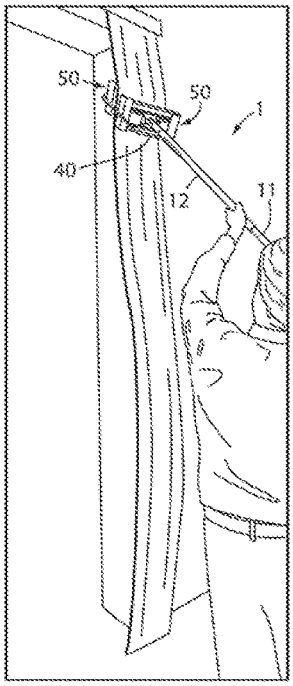
FIG. 9 is a perspective view showing the cleaning tool in position over a plastic curtain strip.
Figure 10:
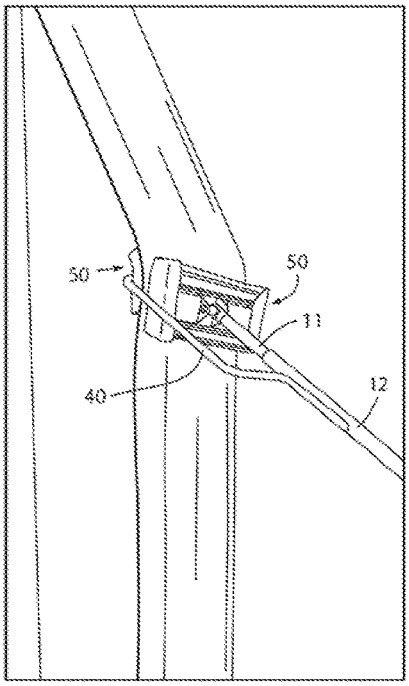
FIG. 10 is a perspective view showing the cleaning tool as it is slid down over a plastic curtain strip, clamped between the proximate and distal cleaning pads of the tool.

In the preferred embodiment, soft wall curtain cleaner 1 includes a handle 10 comprised of an elongated handle tube 11, over which is slidably mounted a shorter handle sleeve 12 (FIG. 1). A proximate pad mount 20 is connected to the end of handle tube 11. A distal pad support arm 40 is connected to handle sleeve 12, which extends past proximate pad mount 20, where it is connected to and supports a distal pad mount 30 (FIGS. 1, 2). Cleaning pads 50 are secured within proximate and distal pad mounts 20 and 30 (FIGS. 3-5). In use, a user grasps handle tube 11 with one hand and sleeve 12 with another, and pushes sleeve 12 away from the user in order to separate the proximate and distal cleaning pads 50. This allows the user to slip a strip of curtain wall into position between the proximate and distal cleaning pads 50 (FIGS. 8 and 9). The user then pulls sleeve 12 toward him or her, thus pressing the proximate and distal cleaning pads against the opposite sides of the curtain wall strip (FIG. 10). The user draws the cleaning tool downwardly to clean both sides of the plastic strip between the proximate and distal cleaning pads.

The various components which make up the preferred embodiment are set forth in Table 1 below by name and identifying number. The terms "proximate" and "distal" as used herein refer to the fact that one of the cleaning pads 50 and its corresponding mount 20 are closer to the user's body, and accordingly are referred to as the proximate pad mount and the proximate cleaning pad, while the other cleaning pad 50 and its mount 30 are positioned further away from the user and accordingly are referred to as the distal pad 50 and distal pad mount 30.

TABLE 1

| Component Listing | |
|---|---|
| Soft wall curtain cleaner | 1 |
| Handle | 10 |
| Handle tube | 11 |
| Slidable handle sleeve | 12 |
| Sleeve slot | 13 |
| Sleeve pin | 14 |
| Proximate pad mount | 20 |
| Stem | 21 |

TABLE 1-continued

| Component Listing | |
|---|---|
| Stem shoulder | 21a |
| Stem retainer | 21b |
| pivot limit stop | 21c |
| Carriage bracket | 22 |
| Base | 22a |
| Legs | 22b |
| Mounting frame | 23 |
| Mounting openings | 23a and 23b |
| Axel | 24 |
| Axel head | 24a |
| bushings | 25a and 25b |
| spacer sleeves | 26a and 26b |
| washers | 27a and 27b |
| nut | 28 |
| Distal pad mount | 30 |
| Carriage bracket | 31 |
| Base | 31a |
| Legs | 31b |
| Mounting frame | 32 |
| Mounting openings | 32a and 32b |
| bushings | 33a and 33b |
| Securement washer | 34 |
| Securement screw | 35 |
| Distal pad mount support arm | 40 |
| Securing leg | 40a |
| Top lateral leg | 40b |
| Descending leg | 40c |
| Bottom lateral leg | 40d |
| Pivot limit stop | 40e |
| Cleaning pads | 50 |
| Sponge pad | 51 |
| Rigid (plastic) backing | 52 |
| Raised mounting platforms | 53a and 53b |
| Fabric holders | 54 |
| Ribs | 55 |

Sleeve 12 includes a slot 13 which is several inches long, and which fits over a sleeve pin 14 which is secured to handle tube 11 (FIG. 2). Slot 13 and pin 14 combine to limit the distance either way which sleeve 12 can be slid back and forth on handle tube 1.

Proximate pad mount 20 is mounted on the end of handle tube 11 (FIG. 2). It comprises a stem 21 which is inserted into the end of handle tube 11 until a shoulder 21*a* engages the end of handle tube 11 and limits further insertion (FIGS. 2, 3). Secured to the end of stem 21 and projecting downwardly therefrom is a pivot limit stop 21*c* which limits the extent to which pad mount 20 and a pad 50 mounted therein can be pivoted fore or aft relative to handle tube 11. A spring biased stem retainer pin 21*b* projects through a hole in handle tube 11 to lock stem 21 in place.

A U-shaped carriage bracket 22 is pivotally mounted on stem 21. Carriage bracket 22 includes a pair of spaced legs 22*b* which project upwardly and parallel to each other from a base 22*a* (FIGS. 2, 3). Carriage bracket 22 is welded or otherwise secured to a pad retainer and mounting frame 23, which is a rectangularly shaped rod or rail frame. Frame 23 defines openings 23*a* and 23*b* on either side of carriage bracket 22, which serve as mounting retainers for a cleaning pad 50.

Upstanding carriage bracket legs 22*b* include apertures therein which receive an axle 24. Axle 24 passes through the apertures in legs 22*b*, and through spacers 26*a* and 26*b* positioned on either side of stem 21 to keep pad mount 20 properly positioned with respect to handle tube 11. Axle 24 also passes through bushings 25*a* and 25*b* and washers 27*a* and 27*b* positioned to the outside of bushings 25*a* and 25*b*. Bushings 25*a* and 25*b* actually seat in the apertures in carriage bracket legs 22*b*. A head 24*a* limits further insertion of axle 24 and a nut 28 is threaded over the free end of axle 24 to secure pad mount 20 to handle tube 11.

Distal pad mount support arm 40 includes a short securing leg 40*a*, which is secured to handle sleeve 12 (FIG. 4). The tube of which support arm 40 is made is bent outwardly at the bottom of short leg 40*a*, to form top lateral leg 40*b* extending outwardly from the bottom of securing leg 40*a*. Leg 40*a* is bent downwardly into descending leg 40*c* which extends down past the outside of proximate pad mount 20. A bottom lateral leg 40*d* then extends laterally beneath distal pad mount 30. A pivot limit stop 40*e* is secured to bottom lateral leg 40*d* and serves to limit the pivotal motion of distal cleaning pad 50 which is mounted to distal pad mount 30.

Distal pad mount 30 includes a carriage bracket 31 which is comparable to carriage bracket 22 of pad mount 20. It comprises a base 31*a* with upstanding legs 31*b*. Carriage bracket 31 is secured to mounting frame 32, which like mounting frame 23 is rectangular in configuration having mounting openings 32*a* and 32*b* for receiving a cleaning pad 50. Bottom lateral leg 40*d* of distal pad mount support arm 40 serves as the axle for the carriage bracket 31 of distal pad mount 30. Leg 40*d* extends through bushings 33*a* and 33*b*, which seat in the apertures in the legs 31*b* of carriage bracket 31. A securement washer 34 is held in place by a securement screw 35 which threads into the opening in the end of tubular distal pad mount support arm 40, thus holding the carriage bracket 31 and distal pad mount 30 in position on bottom lateral leg 40*d*, between pivot limit stop 40*e* and securement washer 34.

Cleaning pads 50 comprise a sponge pad 51 secured to a rigid plastic backing 52. Backing 52 includes raised mounting platforms 53*a* and 53*b* which are rectangularly shaped so as to snap into position within the openings 23*a* and 23*b* in proximate pad mount 20 and in openings 32*a* and 32*b* in distal pad mount 30. Platforms 53*a* and 53*b* also include fabric holders 54, which trap portions of a cleaning fabric wipes wrapped around sponge pad 51 which are pushed into holders 54 by the user. Backing 52 includes upstanding reinforcing ribs 55 to give it added stiffness.

Sponge pads 51 have a flat surface. Backing 52 is sufficiently stiff that the surface of pad 51 tends to stay flat in use. As a result, the flat rectangular pads 51, creates 3 times the surface area contact, compared to prior art comparably sized cleaners. Pads 51 are preferably 4×12.5 inches, providing about 50 square inches of surface contact on each side of a curtain strip.

Figure 6:
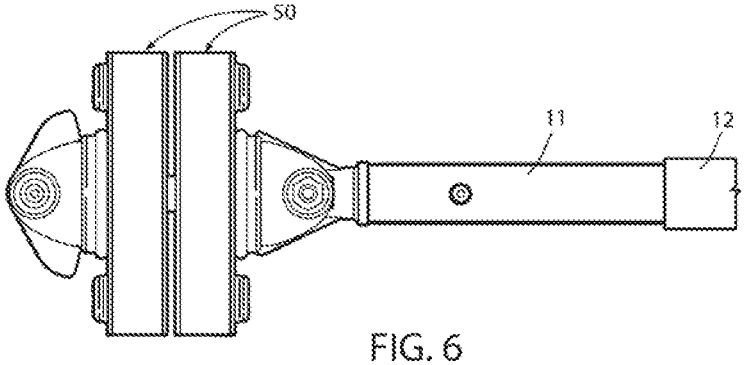
FIG. 6 is a slide elevational view of the cleaning end of the cleaner, with the cleaning pads 50 facing directly opposite each other.
Figure 7:
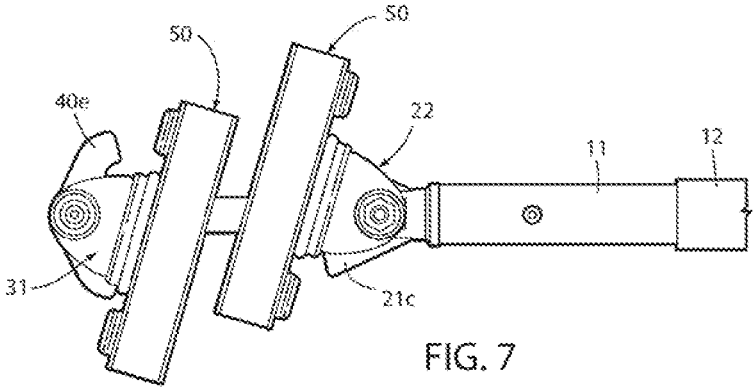
FIG. 7 is a side elevational view of the end of the cleaning tool with the cleaning pads 50 tilted at an angle such that they overlap when pushed together.

Pads 50 are free to pivot slightly to either side of their pad mounts 20 and 30. This can be seen by comparing FIGS. 6 and 7. However pivot limit stops 21*c* and 40*e* limit the extent to which such pivoting can occur. Preferably, the pivot stops allow rotation of about 15° to either side of center. By limiting the angle of rotation in this manner, one tends to maximize the surface area of the pads which are directly opposed one another in use. When pads 50 are centered, they are aligned directly opposite each other as shown in FIG. 6, maximizing the surface contact under pressure. When pads 50 are angled, they align in overlapping fashion as shown in FIG. 7. While this results in somewhat less face to face surface area under pressure in use, it limits the extent to which such contact is diminished by pivoting of the pads.

In use, the user grasps elongated handle 11 in one hand, and sleeve 12 in the other. The user then pushes sleeve 12 away from himself (and/or pulls handle 11 towards himself) so as to separate proximate and distal pads 50, allowing the tool to be slipped over a plastic curtain strip near the top thereof (FIGS. 8 and 9). The user then pulls handle sleeve 12 towards himself (and/or pushes elongated handle 11 away from himself), drawing distal pad 50 and proximate pad 50 towards each other with the curtain strip trapped between them (FIG. 10.) The user then draws or forces the cleaning tool downwardly so that the curtain strip is cleaned on both sides by proximate and distal pads 50.

It is understood that the foregoing is a description of a preferred embodiment of the invention and that various changes and alterations can be made without departing from the spirit and broader aspects thereof as set forth in the appended claims.

The invention claimed is:

1. A soft wall curtain cleaner comprising: an elongated handle over which a slidable handle sleeve is slidably mounted; said elongated handle being connected at its bottom end to a proximate cleaning pad mount; said slideable handle sleeve including a distal cleaning pad mount support arm which extends laterally away from said slideable handle sleeve, then down past and around said proximate cleaning pad mount and supports a distal cleaning pad mount located beyond said bottom end of said elongated handle and said proximate cleaning pad mount, and being oriented towards and generally parallel to said proximate cleaning pad mount; whereby when cleaning pads are mounted on said mounts, a user can hold said elongated handle in one hand and said slidable handle sleeve in the other, slide the handle sleeve away from the user such that the distal mount and the proximate mount, and their associated cleaning pads, are spaced from one another and can be slipped over a curtain strip, then pull the slidable sleeve towards the user, such that the two cleaning pads firmly engage both sides of the curtain strip, and then force the assembly downwardly such that the cleaning pads slide downwardly over the curtain strip and clean it on both sides, throughout its length.

2. The soft wall curtain cleaner of claim 1 in which a cleaning pad is mounted on each of said cleaning pad mounts; said cleaning pads having a flat surface and a backing, which is sufficiently stiff that the surface of said pads tend to stay flat in use.

3. The soft wall curtain cleaner of claim 2 in which said cleaning pad is dimensioned to about 50 square inches of surface contact.

4. The soft wall curtain cleaner of claim 2 in which said proximate pad mount and said distal pad mount each comprise a frame defining at least one pad mounting opening; said backing on each said cleaning pad including at least one raised mounting platform shaped to snap into position within said at least one pad mounting opening in said frame.

5. The soft wall curtain cleaner of claim 4 in which said proximate pad mount includes a carriage which is pivotally mounted to the end of said elongated handle, and said distal pad mount includes a carriage which is pivotally mounted on the end of said distal pad mount support arm.

6. The soft wall curtain cleaner of claim 5 in which a first pivot stop is mounted the end of said elongated handle to limit the degree to which a pad mounted in said proximate cleaning pad mount can be pivoted fore and aft; and a second pivot stop is mounted at the end of said distal cleaning pad support arm to limit the degree to which a pad mounted in said distal cleaning pad mount can be pivoted fore and aft.

7. The soft wall curtain cleaner of claim 6 in which said slidable handle sleeve includes a slot which fits over a sleeve pin secured to elongated handle, to limit the distance either way which said slidable handle sleeve can be slid back and forth on said elongated handle.

8. The soft wall curtain cleaner of claim 1 in which said proximate pad mount and said distal pad mount each comprise a frame defining at least one pad mounting opening therein.

9. The soft wall curtain cleaner of claim 8 in which said proximate pad mount includes a carriage which is pivotally mounted to the end of said elongated handle, and said distal pad mount includes a carriage which is pivotally mounted on the end of said distal pad mount support arm.

10. The soft wall curtain cleaner of claim 9 in which a first pivot stop is mounted the end of said elongated handle to limit the degree to which a pad mounted in said proximate cleaning pad mount can be pivoted fore and aft; and a second pivot stop is mounted at the end of said distal cleaning pad support arm to limit the degree to which a pad mounted in said distal cleaning pad mount can be pivoted fore and aft.

11. The soft wall curtain cleaner of claim 10 in which said distal pad mount support arm includes a short securing leg which is secured to said handle sleeve; a top lateral leg extending outwardly from the bottom of securing leg; a downwardly descending leg which extends down past the outside end of said proximate pad mount; and a bottom lateral leg which extends laterally beneath distal pad mount.

12. The soft wall curtain cleaner of claim 11 in which said distal pad mount is pivotally mounted on said bottom lateral leg; and said second pivot stop is mounted on said bottom lateral leg.

13. The soft wall curtain cleaner of claim 12 in which said slidable handle sleeve includes a slot which fits over a sleeve pin secured to elongated handle, to limit the distance either way which said slidable handle sleeve can be slid back and forth on said elongated handle.

14. The soft wall curtain cleaner of claim 8 in which each said proximate and distal frame is attached to a carriage having a pair of spaced upstanding arms; said upstanding arms on said proximate frame being carried on an axel passing there through and through a stem which is mounted in the end of said elongated handle; said distal pad mount support arm includes a short securing leg which is secured to said handle sleeve, a top lateral leg extending outwardly from the bottom of securing leg, a downwardly descending leg which extends down past the outside end of said proximate pad mount, and a bottom lateral leg which extends laterally beneath distal pad mount; said upstanding arms on said distal support frame being carried on said bottom lateral leg of said distal pad mount support arm.

15. The soft wall curtain cleaner of claim 14 in which said carriage on said proximate pad mount is pivotally carried on said axel; and said carriage on said distal pad mount is pivotally carried on said bottom lateral leg of said distal pad mount support arm.

16. The soft wall curtain cleaner of claim 15 in which a first pivot stop is mounted on said stem to limit the degree to which a pad mounted in said proximate cleaning pad mount can be pivoted fore and aft; and a second pivot stop is mounted on said bottom lateral leg of said distal cleaning pad support arm to limit the degree to which a pad mounted in said distal cleaning pad mount can be pivoted fore and aft.

17. The soft wall curtain cleaner of claim 16 in which each said pivot stop limits the pivot arc of its respective cleaning pad mount to about 30 degrees.

18. The soft wall curtain cleaner of claim 10 in which each said pivot stop limits the pivot arc of its respective cleaning pad mount to about 30 degrees.

19. The soft wall curtain cleaner of claim 1 in which said slidable handle sleeve includes a slot which fits over a sleeve pin secured to elongated handle, to limit the distance either way which said slidable handle sleeve can be slid back and forth on said elongated handle.

20. The soft wall curtain cleaner of claim 19 in which a cleaning pad is mounted on each of said cleaning pad mounts; said cleaning pads having a flat surface and a backing, which is sufficiently stiff that the surface of said pads tend to stay flat in use.

* * * * *